US009013110B2

(12) United States Patent
Chen et al.

(10) Patent No.: US 9,013,110 B2
(45) Date of Patent: Apr. 21, 2015

(54) CIRCUIT FOR DRIVING LIGHT EMITTING ELEMENTS

(75) Inventors: Sean S. Chen, Sunnyvale, CA (US); Jeff Kotowski, Nevada City, CA (US); Timothy James Herklots, Cupertino, CA (US)

(73) Assignee: Atmel Corporation, San Jose, CA (US)

( * ) Notice: Subject to any disclaimer, the term of this patent is extended or adjusted under 35 U.S.C. 154(b) by 434 days.

(21) Appl. No.: 13/308,190

(22) Filed: Nov. 30, 2011

(65) Prior Publication Data

US 2013/0134889 A1 May 30, 2013

(51) Int. Cl.
*H05B 37/00* (2006.01)
*H05B 33/08* (2006.01)

(52) U.S. Cl.
CPC ..... *H05B 33/0815* (2013.01)

(58) Field of Classification Search
USPC ..... 315/193
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 7,948,455 | B2 * | 5/2011 | Han et al. | 345/82 |
| 2006/0146553 | A1 * | 7/2006 | Zeng et al. | 362/488 |
| 2011/0062872 | A1 * | 3/2011 | Jin et al. | 315/122 |
| 2011/0204797 | A1 * | 8/2011 | Lin et al. | 315/161 |
| 2012/0001557 | A1 * | 1/2012 | Hagino et al. | 315/192 |
| 2012/0256554 | A1 * | 10/2012 | Um et al. | 315/224 |
| 2013/0093338 | A1 * | 4/2013 | Chen et al. | 315/192 |

OTHER PUBLICATIONS

Atmel, "Atmel mSilica LED Driver Technology: Smart LED power management offering efficiency, programmability and scalability," www.atmel.com, 4 pages (2011).
Atmel, Atmel LED Driver-MSL2100: 8-string, High-power, White or RGB LED Drives for TVs, Monitors or Intelligent Solid-state Lightning, pp. 1-20 (2011).
MPS, The Future of Analog, IC Technology®, "MP4601-White LED Driver for Large Size TV Backlighting," pp. 1-16, www.MonolithicPower.com, MP4601 Rev. 1.0 (Jan. 28, 2011).
LEDs Magazine—National Semiconductor's high-brightness LED driver simplifies area-li.: "How does your LED materials partner improve your manufacturing efficiency?," http://www.ledsmagazine.com/products/31635, p. 1 of 1 (printed on Mar. 12, 2012.

* cited by examiner

*Primary Examiner* — Thienvu Tran
(74) *Attorney, Agent, or Firm* — Fish & Richardson P.C.

(57) ABSTRACT

In one novel aspect, driving a string of light emitting elements, such as LEDs, includes applying a drive signal to circuitry that regulates a voltage appearing at a source of a transistor whose drain is coupled to one end of the string of light emitting elements and whose source is coupled to ground through a resistive element. Sequencing of the drive signal and a voltage supply signal for the light emitting elements is controlled such that the voltage supply signal is not increased above a predetermined allowable voltage for the transistor until the transistor is turned on, and such that the supply voltage is not decreased below the allowable voltage for the transistor until the transistor is turned off.

18 Claims, 3 Drawing Sheets

CIRCUIT FOR DRIVING LIGHT EMITTING ELEMENTS

BACKGROUND

This disclosure relates to circuits for driving light emitting elements, for example, light emitting diodes (LEDs).

LEDs are current-driven devices whose brightness is proportional to their forward current. Forward current can be controlled in various ways. For example, one technique is to use the LED current-voltage (I-V) curve to determine what voltage needs to be applied to the LED to generate a desired forward current. Another technique of regulating LED current is to drive the LED with a constant-current source. The constant-current source can help eliminate changes in current due to variations in forward voltage, which results in constant LED brightness. In this technique, rather than regulating the output voltage, the input power supply regulates the voltage across a current-sense resistor. For example, an operational amplifier can be used to regulate the voltage appearing at the source of a power transistor that is coupled between the current-sense resistor and the LED string. The power supply reference voltage and the value of the current-sense resistor determine the LED current.

One issue that arises in some LED driver circuits is high power consumption. Another issue is that the power transistor typically must be a high-voltage device that is able to withstand the relatively high voltage supply.

SUMMARY

The subject matter described in this disclosure relates to circuits for driving light emitting elements, which in some implementations, can help reduce power consumption.

For example, in one novel aspect, driving a string of light emitting elements, such as LEDs, includes applying a drive signal to circuitry that regulates a voltage appearing at a source of a transistor, whose drain is coupled to one end of the string of light emitting elements and whose source is coupled to ground through a resistive element. Sequencing of the drive signal and a voltage supply signal for the light emitting elements is controlled such that the voltage supply signal is not increased above a predetermined allowable voltage for the transistor until the transistor is turned on, and such that the supply voltage is not decreased below the allowable voltage for the transistor until the transistor is turned off.

Some implementations include one or more of the following features. For example, the sequencing can be controlled such that the supply voltage starts to increase from a low voltage before the transistor is turned on, but is not increased above the maximum allowable voltage for the transistor until the transistor is turned on. Likewise, the sequencing can be controlled such that the supply voltage starts to decrease from a high voltage before the transistor is turned off, but is not decreased below the allowable voltage for the transistor until the transistor is turned off.

Circuitry for implementing the techniques is described below and can be used either with analog drive signals, or pulse width modulation (PWM) drive signals in which the dimming is accomplished by adjusting the on-time (or duty cycle) to obtain a desired brightness.

Some implementations include one or more of the following advantages. For example, a low-voltage transistor can be used to drive the LED string, which can result in lower manufacturing costs. Furthermore, the drive circuitry can be used with analog driving techniques as well as with PWM driving techniques.

Other potential aspects, features and advantages will be readily apparent from the following detailed description, the accompanying drawings, and the claims.

DETAILED DESCRIPTION

The driver technology described in this disclosure can be used, for example, in backlighting and solid-state lighting applications that incorporate LEDs or other light emitting elements. Examples of such applications include LCD TVs, PC monitors, specialty panels (e.g., in industrial, military, medical, or avionics applications) and general illumination for commercial, residential, industrial and government applications. The LED driver technology described here can be used in other applications as well, including backlighting for various handheld devices. The driver circuit can be implemented, for example, as an integrated circuit fabricated on a silicon or other semiconductor substrate.

Figure 1:
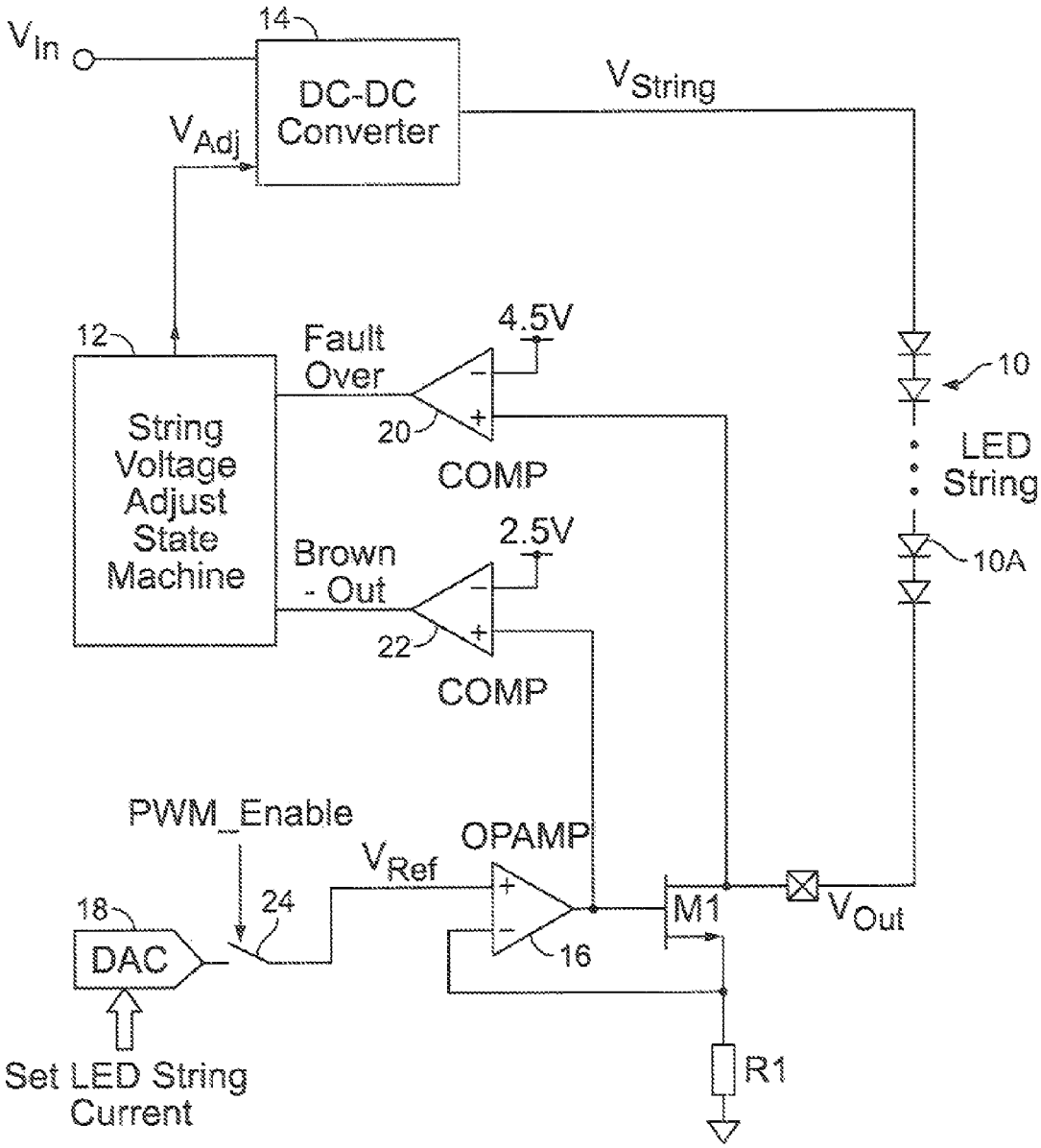
FIG. 1 illustrates an example of a circuit for driving a LED string.

As illustrated in FIG. 1, an output from a LED driver circuit is coupled to a LED string 10. In the illustrated example of FIG. 1, the LED string 10 includes ten LEDs 10A connected in series. In some implementations, the number of LEDs in each string 10A may differ from ten.

As further shown in FIG. 1, to drive the LED string 10, a reference voltage Vref is applied at the non-inverting input (+) of an operational amplifier 16. The reference voltage Vref, which may be referred to as a drive signal, can be set, for example, by a microcontroller or other circuitry that provides input signals to a digital-to-analog converter (DAC) 18, whose output can be coupled to the non-inverting input (+) of the operational amplifier 16 by closing a switch 24. The position of the switch 24 can be controlled, for example, by a signal PWM_Enable. When the PWM_Enable signal is low (i.e., a digital '0'), the switch 24 connects the non-inverting input (+) of the operational amplifier 16 to ground. When the PWM_Enable signal is high (i.e., a digital '1'), the switch 24 connects the output of the DAC 18 to the non-inverting input (+) of the operational amplifier 16. During operation, substantially the same voltage appears at the inverting input (−) of the operational amplifier 16, and this voltage appears across the resistor R1, which is coupled between the source of a transistor M1 and ground. Thus, the operational amplifier 16 regulates the voltage appearing at the source of transistor M1 by maintaining the voltage at the inverting input (−) at the same level as the voltage appearing at the non-inverting input (+). The resistive element R1 can be implemented, for example, as a single resistive component or as a combination of resistive components connected in series and/or in parallel.

As further shown in FIG. 1, the output of the operational amplifier 16 is coupled to the gate of transistor M1. The current for driving the LED string 10 flows through the transistor M1, whose drain is coupled to the LED string. The transistor M1 can be implemented, for example, as a MOS transistor.

The supply voltage (Vstring) applied to the LED string 10 is set by an input voltage (Vin) provided to a DC-DC converter 14, whose output is coupled to an end of the LED string opposite the end of the LED string to which the transistor M1 is coupled. The voltage Vstring can be adjusted by a state machine 12 that provides a control signal (Vadi) to the DC-DC converter 14. The state machine 12 can be implemented, for example, by cascaded latches, a microprocessor or other circuitry.

As explained below, in one novel aspect, sequencing of the LED string drive signal (Vref) and the supply voltage (Vstring) applied to the LED string 10 is controlled so as to limit the voltage seen by the transistor M1. In some implementations, the sequencing can allow a low-voltage transistor (e.g., 5-10 volts), rather than a high-voltage transistor (20-30 volts), to be used to drive the LED string 10. Furthermore, the sequencing can be used both in analog and PWM dimming techniques for adjusting the LED intensity.

Figure 2:
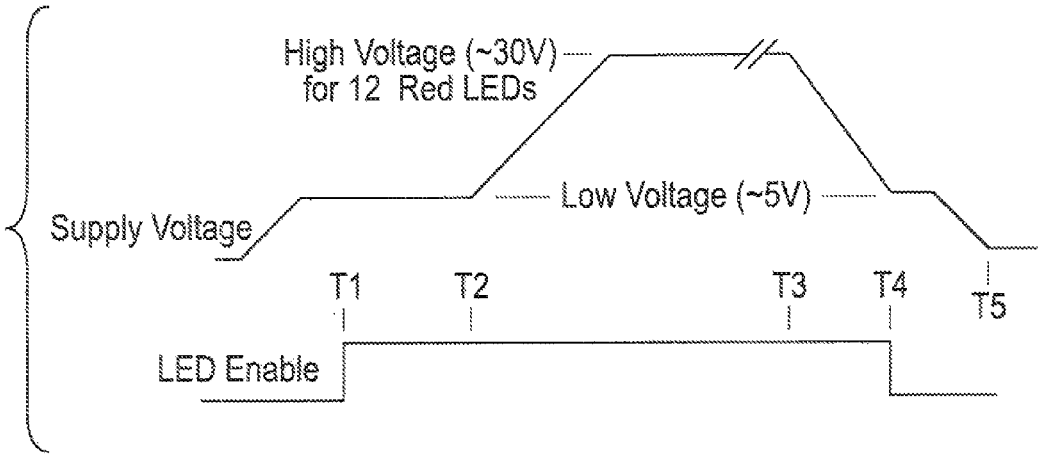
FIG. 2 illustrates an example of sequencing for the LED string drive and the supply voltage applied to the LED string.

FIG. 2 illustrates an example of the sequencing for the LED string drive (Vref) and the supply voltage (Vstring) applied to the LED string 10. As illustrated, the drive transistor M1 is turned on by raising the reference voltage Vref to a high level (e.g., at time T1) before the supply voltage increases to the allowable voltage on the transistor. For example, if the maximum allowable voltage on the transistor M1 (i.e., the drain-source voltage) is five volts, then the voltage Vstring should not be increased above five volts until after the transistor M1 is turned on (e.g., at time T2). As further shown in the example of FIG. 2, the voltage Vstring can start to increase before the transistor M1 is turned on (i.e., before time T1); however, the voltage Vstring should not be increased above the allowable voltage on the transistor M1 until after the transistor is turned on. Subsequently, so long as the transistor M1 is on, the voltage string can be maintained at a high level (e.g., 30 volts for twelve red LEDs) to provide the required voltage across the LED-string 10.

When turning off the transistor M1, the voltage Vstring should not be decreased below the allowable voltage on the transistor M1 until after the transistor M1 is turned off. As illustrated in FIG. 2, if the transistor M1 is turned off at time T4, then the voltage Vstring should not be decreased below the allowable voltage rating (e.g., 5 volts) until at, least that time. Here too, the voltage Vstring can begin to decrease from the high voltage at an earlier time (e.g., time T3); however, the voltage Vstring should not be decreased below the allowable voltage on the transistor M1 until after the transistor is turned off. Once the transistor M1 is turned off, the voltage Vstring can continue to be decreased below the transistor's allowable voltage (i.e., the voltage Vstring can be decreased to zero volts).

As shown in FIG. 1, the LED driver circuitry can include comparators 20, 22 to provide feedback to the state machine 12. For example, comparator 22 has a non-inverting input (+) coupled to the output of the operational amplifier 16, and an inverting input (−) coupled to a reference voltage (e.g., 2.5 volts). The output of the comparator 22 is provided to the state machine 12. If, for example, the voltage Vstring applied to the LED string 10 is too low such that the operational amplifier 16 cannot regulate the LED current, the comparator 22 detects that the output of the operational amplifier is going high as it attempts to turn on the transistor M1 harder. In that case, the output signal ("brown-out") from the comparator 22 indicates to the state machine 12 that the voltage (Vout) at the drain of the transistor M1 needs to be raised by increasing Vstring. Otherwise, the state machine 12 attempts to reduce the output voltage periodically to maintain Vstring at the lowest practical limit. For example, in some implementations, the state machine 12 periodically (e.g., once every 10 seconds) reduces the Vstring voltage by a first predetermined small amount. If this reduction in the Vstring voltage causes the LED string driver to start to brown out such that the operational amplifier 16 can no longer regulate the LED current, the comparator 22 will detect this condition and provide a signal (i.e., the "brown-out" signal) to the state machine 12 to cause the state machine to increase the Vstring voltage by a second predetermined small amount. In some implementations, the first and second predetermined amounts are the same; in other implementations, they may differ. This technique can be used to help ensure that the proper sequencing occurs between the Vstring voltage and the LED drive voltage.

The other comparator 20 has a non-inverting input (+) coupled to the drain of the transistor M1, and an inverting input (−) coupled to a reference voltage (e.g., 4.5 volts). The output of the comparator 20 is provided to the state machine 12, which allows the state machine to monitor the voltage (Vout) at the drain of the transistor M1 in order to control the voltage Vstring. The comparator 20 can be used, for example, to detect a string fault, such as a direct short across all the LEDs 10A. In that case, the output signal ("fault over") from the comparator 20 controls the state machine to turn off the DC-DC converter 14 so that the sink transistor 16 does not dissipate too much power.

As noted above, the sequencing discussed above can allow a low-voltage transistor, rather than a high-voltage transistor, to be used to drive the LED string 10. In particular, if the LED driver is on, the drain voltage of the transistor M1 can be kept low, which allows a low voltage power transistor to be used.

When the LED driver is on (i.e., when the voltage reference Vref is high so as to turn on the transistor M1), the voltage on the drain of the transistor M1 is low. However, when the LED driver turns off (i.e., when the voltage reference Vref is zero or very close to zero), the drain voltage becomes close to the supply voltage Vstring, which is a high voltage (e.g., 20-30 volts). Therefore, if a low voltage transistor M1 is used, dimming of the LEDs 10A should be performed using analog techniques rather than pulse width modulation (PWM) techniques that involve turning the transistor M1 completely off while the supply voltage (Vstring) applied to the LED string 10 remains at a high level (e.g., 20-30 volts).

Nevertheless, as explained below, a low-voltage transistor (e.g., 5-10 volts) also can be used in the drive circuit of FIG. 1 for PWM control. To allow PWM control using a low-voltage transistor, the power transistor M1 needs to be able to withstand the high voltage Vstring. This can be accomplished, for example, by not turning off the transistor M1 completely during PWM operation. In particular, instead of driving the reference voltage Vref to zero volts so as to turn off the transistor M1 completely for the PWM off pulse, the reference voltage Vref is driven to a very low value such that it almost turns off the LED string 10, yet still allows a small current to pass through the LED string even during PWM off time. In general, the value of the reference voltage Vref used for the low PWM pulse should be selected such that the voltage across the transistor M1 (i.e., the drain-source voltage) remains less than its allowable voltage even if a relatively high Vstring voltage is being applied to the LED string 10. The description in the following paragraphs elaborates on how this PWM control can be accomplished.

Figure 3:
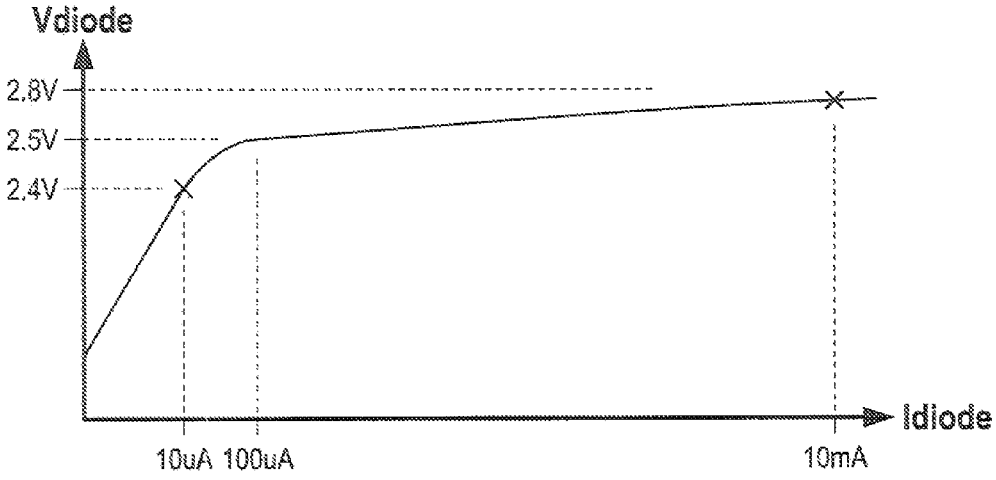
FIG. 3 illustrates an example of forward-biased current-voltage (I-V) characteristics of a LED.

FIG. 3 illustrates an example of the forward-biased current-voltage (I-V) characteristics of a typical LED. Although LEDs vary from part-to-part and from manufacturer-to-manufacturer, the curve of FIG. 3 represents an example of general LED behavior. In the example of FIG. 3, the LED is assumed to have a current of about 10 mA when its forward-biased voltage is about 2.8 volts. Likewise, when the current is only about 10 uA (i.e., a thousand-fold difference from the high value of 10 mA), the forward-biased voltage is about 2.4 volts. The graph of FIG. 3 is for a single LED device. The voltage for a LED string consisting of N LEDs in series will have a voltage drop N times larger than the single device illustrated in FIG. 3, where N represents the number of LEDs.

For example, consider a LED string consisting of ten LEDs in series, each of which has the I-V characteristics shown in FIG. 3. Assuming that the on-current is 10 mA for the high PWM pulse, the off-current can be lowered to about 10 uA for the low PWM pulse, while maintaining about a 1000:1 dimming ratio. Using the I-V characteristics of FIG. 3, when the PWM pulse is high, the string of ten LEDs will have a forward-biased voltage of about 28 volts (i.e., 10×2.8 volts/LED). When the PWM pulse is low enough such that the LED string is almost turned off (but still draws a current of about 10 uA), the same string of LEDs will have about 24 volts across it (i.e., 10×2.4 volts/LED). The voltage across the LED string, therefore, differs only by about four volts between the high and low PWM pulses, which means that the 28-volt LED string can be driven using a 5-volt (i.e., low-voltage) transistor.

Figure 4:
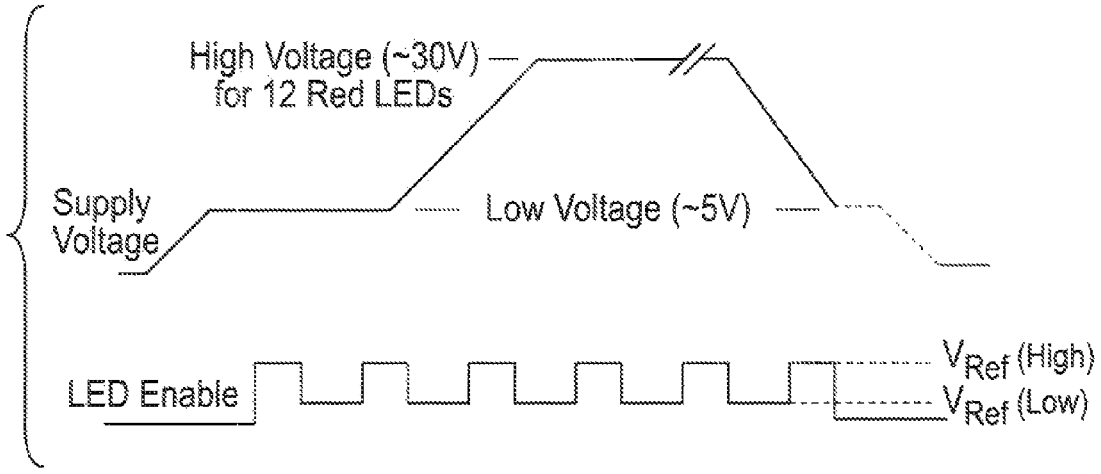
FIG. 4 illustrates an example of sequencing for the LED string drive and the supply voltage applied to the LED string for PWM operation.

For PWM operation, the value of the reference voltage Vref can be selected such that it equals the value of the desired current through the LED string 10 multiplied by the value of the resistive element R1. Thus, using the foregoing example, for a high PWM pulse, the reference voltage Vref(high) would be set equal to about (10 mA·R1), and for a low PWM pulse, the reference voltage Vref(low) would be set equal to about (10 uA·R1), as illustrated in FIG. 4.

Other implementations are within the scope of the claims.

What is claimed is:

1. A method of driving a string of light emitting elements, the method comprising:

applying a PWM drive signal to circuitry that regulates a voltage appearing at a source of a transistor, wherein a drain of the transistor is coupled to one end of the string of light emitting elements and wherein the source is coupled to ground through a resistive element; and controlling sequencing of the PWM drive signal for the string of light emitting elements and a voltage supply signal for the light emitting elements such that the voltage supply signal starts to increase from a low voltage before the transistor is turned on, but is not increased above a predetermined allowable voltage for the transistor until the transistor is turned on, and such that the voltage supply signal starts to decrease from a high voltage before the transistor is turned off, but is not decreased below the allowable voltage for the transistor until the transistor is turned off.

2. The method of claim 1 including:

detecting whether an amplitude of the voltage supply signal is insufficient to allow a current in the string of light emitting elements to be regulated; and increasing the voltage supply signal by a first predetermined amount.

3. The method of claim 2 including periodically reducing the amplitude of the voltage supply signal by a second predetermined amount.

4. The method of claim 1 wherein the PWM drive signal includes on and off pulses and wherein the off pulses are at low voltage level so as almost to turn off the string of light emitting elements, yet still allow a small current to pass through the string of light emitting elements.

5. The method of claim 1 wherein the PWM drive signal includes on and off pulses and wherein, during both the on and off pulses, a voltage across the transistor remains less than the allowable voltage.

6. The method of claim 5 wherein a current flowing through the string of light emitting elements during the off pulses is at least one thousand times less than a current flowing through the string of light emitting elements during the on pulses.

7. The method of claim 1 wherein the light emitting elements are LEDs.

8. A circuit for driving a string of one or more light emitting elements, the circuit comprising:

a transistor having a drain arranged to be coupled to one end of the string of one or more light emitting elements;

an operational amplifier to regulate a voltage appearing at a source of the transistor wherein a first input of the operational amplifier is operable to receive a drive signal for driving the string of one or more light emitting elements;

circuitry to adjust a voltage supply signal applied to the string of one or more light emitting elements, wherein the circuitry to adjust the voltage supply signal comprises a state machine that is operable to provide a control signal to a DC-DC converter having an output arranged to be coupled to the string of one or more light emitting elements; and circuitry to control sequencing of the drive signal and the voltage supply signal such that the voltage supply signal is not increased above a predetermined allowable voltage on the transistor until the transistor is turned on, and such that the voltage supply signal is not decreased below the allowable voltage on the transistor until the transistor is turned off.

9. The circuit of claim 8 wherein the source of the transistor is coupled to ground through a resistive element, a gate of the transistor is coupled to an output of the operational amplifier, and a second input of the operational amplifier is coupled to the source of the transistor.

10. The circuit of claim 8 wherein the transistor has a maximum allowable voltage in a range of 5 to 10 volts.

11. The circuit of claim 10 wherein, when fully turned on, a power supply signal reaches at least 20 volts.

12. The circuit of claim 8 wherein the circuitry to control the sequencing is arranged such that the voltage supply signal starts to increase from a low voltage before the transistor is turned on, but is not increased above the allowable voltage for the transistor until the transistor is turned on.

13. The circuit of claim 8 wherein the circuitry to control the sequencing is arranged such that the voltage supply signal starts to decrease from a high voltage before the transistor is turned off, but is not decreased below the allowable voltage for the transistor until the transistor is turned off.

14. The circuit of claim 8 including brown-out detection circuitry to detect whether an amplitude of the voltage supply signal is so low that the operational amplifier cannot regulate a current in the string of one or more light emitting elements and, if so, to provide a signal to the state machine to increase the voltage supply signal by a first predetermined amount.

15. The circuit of claim 14 wherein the state machine is operable to periodically reduce the amplitude of the voltage supply signal by a second predetermined amount.

16. The circuit of claim 15 wherein the brown-out detection circuitry comprises a comparator having a first input coupled to a drain of the transistor, having a second input coupled to a predetermined voltage level, and having an output coupled to the state machine.

17. An apparatus comprising:

a plurality of LEDs in series with one another;

a circuit to drive the LEDs wherein the circuit includes:

a transistor having a drain coupled to one end of the plurality of LEDs and having a source coupled to ground through a resistive element;

an operational amplifier to regulate a voltage appearing at the source of the transistor wherein a first input of the operational amplifier is configured to receive a drive signal;

circuitry to adjust an amplitude of a DC voltage supply signal applied to a second end of the plurality of LEDs, wherein the circuitry to adjust an amplitude of the DC voltage supply signal comprises a state machine coupled to the second end of the plurality of LEDs;

circuitry to control sequencing of the drive signal and the DC voltage supply signal such that the DC voltage supply signal is not increased above a predetermined allowable drain-source voltage of the transistor until the transistor is turned on, and such that the DC voltage supply signal is not decreased below the allowable drain-source voltage of the transistor until the transistor is turned off; and brown-out detection circuitry to detect that the operational amplifier cannot regulate a current in the plurality of LEDs and to provide a signal to the state machine to increase the DC voltage supply signal by a first predetermined amount, wherein the state machine is operable to reduce the amplitude of the DC voltage supply signal periodically by a second predetermined amount.

18. The apparatus of claim 17 wherein the transistor has a maximum allowable drain-source voltage in a range of 5 to 10 volts.

* * * * *

UNITED STATES PATENT AND TRADEMARK OFFICE

CERTIFICATE OF CORRECTION

PATENT NO. : 9,013,110 B2
APPLICATION NO. : 13/308190
DATED : April 21, 2015
INVENTOR(S) : Sean S. Chen et al.

It is certified that error appears in the above-identified patent and that said Letters Patent is hereby corrected as shown below:

Title Page item (56) Col. 2 Line 5 – Delete "Drives" and insert --Drivers--, therefor.

Title Page item (56) Col. 2 (Other Publications) Line 6 – Delete "Lightning," and insert --Lighting,--, therefor.

In the Specification

Column 3 Line 6 – Delete "(Vadi)" and insert --(Vadj)--, therefor.

Column 3 Line 42 – Delete "at," and insert --at--, therefor.

Signed and Sealed this
Eighth Day of September, 2015

Michelle K. Lee

Michelle K. Lee
*Director of the United States Patent and Trademark Office*